US005570965A

United States Patent [19]

Coolen

[11] Patent Number: 5,570,965

[45] Date of Patent: Nov. 5, 1996

[54] WRITING INSTRUMENT CLIP ASSEMBLY

[75] Inventor: James A. Coolen, Warwick, R.I.

[73] Assignee: C & J Jewelry Co., Inc., Providence, R.I.

[21] Appl. No.: 522,701

[22] Filed: Sep. 1, 1995

[51] Int. Cl.[6] ..... B43K 23/00

[52] U.S. Cl. ..... 401/98; 24/11 P; 401/104

[58] Field of Search ..... 24/11 P, 11 R, 24/11 M, 11 HC; 401/98, 131, 124, 202, 247, 104

[56] References Cited

U.S. PATENT DOCUMENTS

| | | | |
|---|---|---|---|
| 2,405,176 | 8/1946 | Barber | 24/11 M |
| 2,498,857 | 2/1950 | Kanner | 24/11 P |
| 4,837,900 | 6/1989 | Boyce et al. | 401/98 X |
| 5,127,754 | 7/1992 | Mase | 401/202 |
| 5,186,564 | 2/1993 | Fuhrmann, III et al. | 401/202 |

FOREIGN PATENT DOCUMENTS

| | | | |
|---|---|---|---|
| 918383 | 10/1946 | France | 24/11 P |
| 970151 | 6/1950 | France | 24/11 P |
| 818614 | 10/1951 | Germany | 24/11 P |

*Primary Examiner*—Robert A. Hafer
*Assistant Examiner*—D. Neal Muir
*Attorney, Agent, or Firm*—Breiner & Breiner

[57] ABSTRACT

A clip assembly is disclosed to provide a pivotal clip for a writing instrument or the like. The clip assembly comprises an inner sleeve, a spring, a clip and a cap top assembly. The clip assembly allows a writing instrument or the like to be clipped onto a surface without weakening or deforming the clip.

6 Claims, 1 Drawing Sheet

38
40
22
20
36
32
35
24
10
14
34
28
42
26
18
16
30
12
13
28
40
26

WRITING INSTRUMENT CLIP ASSEMBLY

FIELD OF INVENTION

This invention relates to a clip for a writing instrument, and more particularly, to a novel means for attaching a writing instrument to a shirt pocket, notebook or other surface, to provide advantages over the prior art.

BACKGROUND OF THE INVENTION

In early prior art, a writing instrument was attached to a surface such as a shirt pocket by means of a bendable clip. In use, the clip was bent outward to receive the surface. Although this type of clip was initially secure, the constant bending and deforming of the clip eventually caused it to weaken and wear out long before the writing instrument.

More recent prior art discloses a writing instrument clip as shown in FIG. 1, having a clip pivotally mounted on a spring housed within the writing instrument. However, this clip has disadvantages in that, among other things, the cap top can be unscrewed and the parts can fall out and get lost. Further, the clip is held tight to the cap and in use does not allow thicker materials to slide to the top of the clip without opening the clip.

PRIMARY OBJECTS AND GENERAL DESCRIPTION OF THE INVENTION

It is a primary object of the present invention to provide a novel means for clipping a writing instrument to a surface.

It is a further primary object of the present invention to provide a clip assembly for a writing instrument or the like, which will allow the clip means to pivot rather than bend, so that the clip is not stretched and deformed when the clip means is attached to another surface.

It is a further object of the invention to provide a clip assembly for a writing instrument or the like which prevents the clip means from weakening and will thereby allow it to function properly for the entire life of the writing instrument and protect the consumer's investment in the writing instrument.

It is a further object of the invention to provide a clip assembly which is permanently attached to the cap of a writing instrument.

It is another object of the invention to provide a unitary clip assembly which is self-contained and easily attached to the cap of the writing instrument in the assembly thereof.

The writing instrument clip assembly of the invention includes a clip assembly having an inner sleeve, a spring mounted on the inner sleeve, a clip means having an aperture pivotally mounted on the spring and a cap top assembly extending through the aperture and the inner sleeve. The clip assembly is mounted within the cap of a writing instrument and provides a clip which will move instead of stressing the metal at the bend and which can be repeated numerous times with the same results.

Other objects and advantages of the present invention will become apparent in the following detailed description of the invention taken in conjunction with the appended drawing.

DETAILED DESCRIPTION OF THE INVENTION

Figures 1, 2, 3, 4, 5:
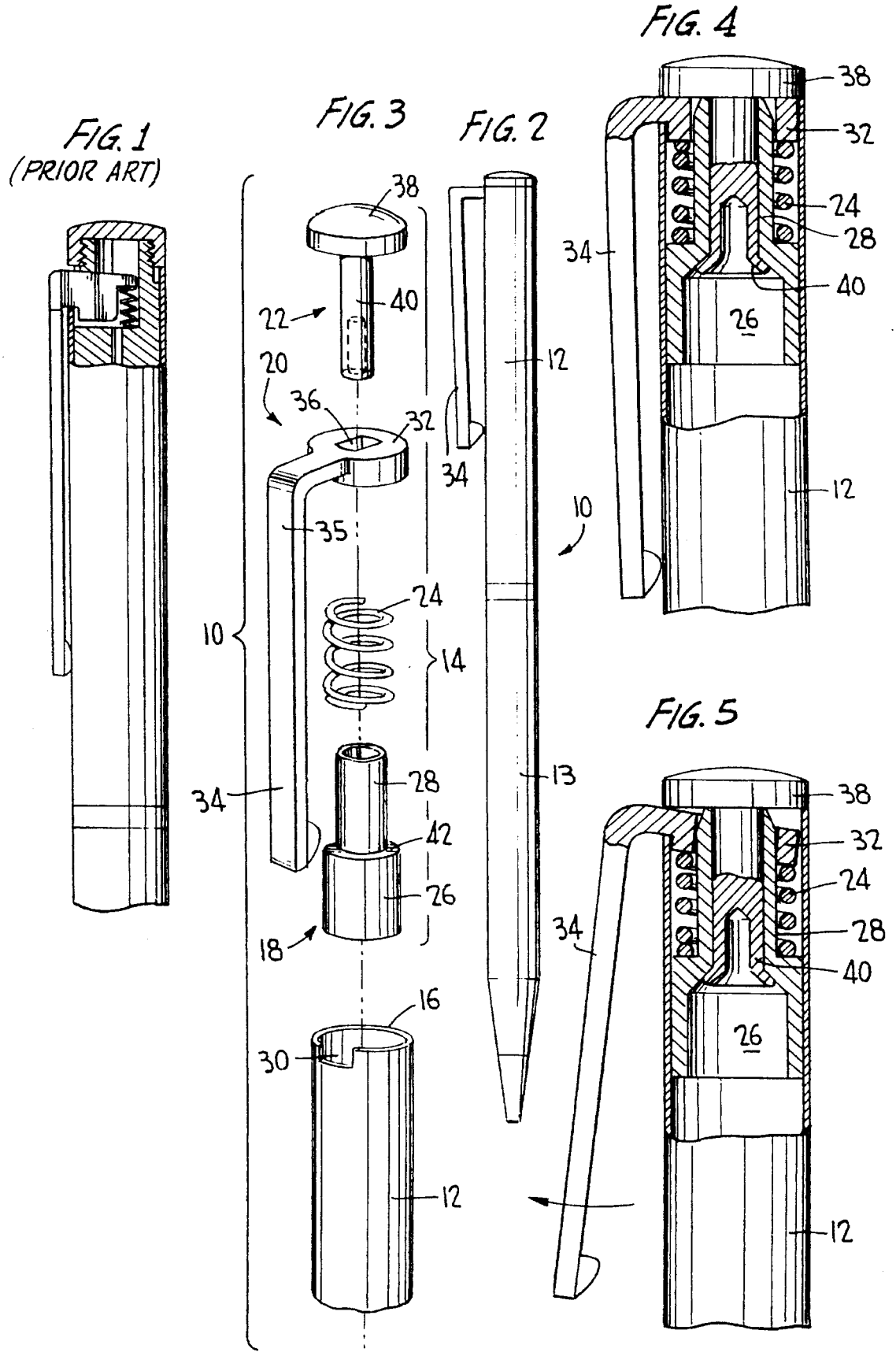
FIG. 1 (PRIOR ART)
FIG. 1 is a partial cross sectional view of the prior art.
FIG. 2 is a side view of a writing instrument containing the clip assembly of the invention.
FIG. 3 is a partial exploded view of the clip assembly and cap of FIG. 2.
FIG. 4 is a partial cross sectional view of the clip assembly of FIG. 2 at rest.
FIG. 5 is a partial cross sectional view of the clip assembly of FIG. 2 in an outwardly extended position.

Referring to FIG. 2, there is shown a writing instrument 10 having a cad 12, barrel 13 and a clip assembly generally designated 14.

The illustrated embodiment of the writing instrument as shown in FIG. 3 is generally designated 10, which includes a cap 12 and a clip assembly 14.

The cap 12 is a hollow housing having an open end 16 for receiving the clip assembly 14. The clip assembly 14 comprises an inner sleeve 18, a clip means 20, a cap top assembly 22, and a spring 24.

The inner sleeve 18 includes a means for mounting the spring 24 and the clip means 20. The inner sleeve comprises a base end 26 and a hollow receiving end 28 that opens away from the base end 26. The base end 26 has a diameter sufficient to fit snugly against an inner wall 30 of the cap 12. The receiving end 28 has a diameter and length sufficient to receive the spring 24. The spring 24 is constructed and arranged so as to be mounted on the receiving end 28 and fit inside the barrel 12.

The clip means 20 has an annular portion 32 and a longitudinally extending portion 34 joined by angle 35 at approximately 93°. The annular portion 32 includes an aperture 36.

The cap top assembly 22 includes a head 38 and a stem 40.

When the clip assembly 14 is assembled, the spring 24 is mounted on inner sleeve 18. The annular portion 32 of clip means 20 is pivotally mounted between the spring 24 and the head 38. The stem 40 extends through the aperture 36 and into receiving end 28 of inner sleeve 18 and is flared (swedged) thereby securing the clip means 20 against the spring 24. The clip assembly thereby becomes permanently connected as a single unit. The clip assembly 14 is permanently attached to the cap by Loctite sealant or any other sealing means. The clip assembly may be connected to the cap by other means, including nonpermanent means.

As shown in FIG. 4, the longitudinal portion 34 of clip means 20 sits against the outer surface of the cap 12 when the clip assembly 14 is at rest. When the clip assembly 14 is in use as shown in FIG. 5, the longitudinal portion 34 is pulled outward. This motion causes the annular portion 32 to pivot downwardly and compress the spring 24. The spring 24 will remain compressed as long as the longitudinal portion 34 is held in an outward position.

Various modifications will be recognized by those skilled in the art based on the present teachings. Thus, although only the preferred embodiment has been specifically illustrated and described herein, it needs to be understood that various modifications and embodiments can be utilized to provide the clip assembly of the present invention without departing from the spirit of the invention and the scope of the appended claims. For example, the clip assembly 10 can be attached to flashlights, pointers or other devices that can be clipped onto a surface.

It is claimed:

1. A writing instrument comprising:

a cap means and a clip assembly inserted in said cap means, said clip assembly comprising a hollow, essentially cylindrical inner sleeve having a hollow spring receiving end at a top end, a spring means mounted upon said receiving end of said inner sleeve, a clip means having an aperture and pivotally mounted on said spring means, and a cap top assembly means extending through said aperture and into said inner sleeve.

2. The invention according to claim 1 wherein said cap top assembly means includes a head and a stem.

3. The invention according to claim 2 wherein said stem is secured to said inner sleeve by being flared.

4. A writing instrument comprising:

a cap means and a barrel means and a clip assembly inserted in said cap means, said clip assembly comprising a hollow, essentially cylindrical inner sleeve having a hollow spring receiving end at a top end, a spring means mounted upon said receiving end of said inner sleeve, a clip means having an aperture and pivotally mounted on said spring means, and a cap top assembly means extending through said aperture and into said inner sleeve.

5. The invention according to claim 4 wherein said cap top assembly means includes a head and a stem.

6. The invention according to claim 5 wherein said stem is secured to said inner sleeve by being flared.

* * * * *